US012515851B2

(12) United States Patent
Ritzberger et al.

(10) Patent No.: US 12,515,851 B2
(45) Date of Patent: Jan. 6, 2026

(54) CONTAINER HAVING A LOCKABLE COVER

(71) Applicant: Georg Utz Holding AG, Bremgarten (CH)

(72) Inventors: Axel Ritzberger, Altendorf (CH); Heiner Ennen, Nordhorn (DE)

(73) Assignee: GEORG UTZ HOLDING AG, Bremgarten (CH)

( * ) Notice: Subject to any disclaimer, the term of this patent is extended or adjusted under 35 U.S.C. 154(b) by 857 days.

(21) Appl. No.: 17/625,142

(22) PCT Filed: Jul. 6, 2020

(86) PCT No.: PCT/IB2020/056331
§ 371 (c)(1),
(2) Date: Jan. 6, 2022

(87) PCT Pub. No.: WO2021/005486
PCT Pub. Date: Jan. 14, 2021

(65) Prior Publication Data

US 2022/0267058 A1 Aug. 25, 2022

(30) Foreign Application Priority Data

Jul. 11, 2019 (CH) ..... 901/19

(51) Int. Cl.
*B65D 43/22* (2006.01)
*B65D 21/02* (2006.01)
(Continued)

(52) U.S. Cl.
CPC ..... *B65D 43/22* (2013.01); *B65D 21/0212* (2013.01); *B65D 43/163* (2013.01);
(Continued)

(58) Field of Classification Search
CPC ..... B56D 43/22; B56D 43/163; B56D 2251/1025; B56D 2251/1083; B56D 2215/02; B56D 50/046; E05C 9/02
(Continued)

(56) References Cited

U.S. PATENT DOCUMENTS 3,463,345 A * 8/1969 Bockenstette ..... B65D 21/064 206/508
3,622,205 A * 11/1971 Zamboni ..... E01H 4/023 37/219
(Continued)

FOREIGN PATENT DOCUMENTS

CN 108839953 A 11/2018
JP 2001082445 A 3/2001
(Continued)

OTHER PUBLICATIONS

International Search Report for PCT/IB2020/056331 Dated Oct. 6, 2020.

*Primary Examiner* — Don M Anderson
*Assistant Examiner* — Jennifer Castriotta
(74) *Attorney, Agent, or Firm* — Greer, Burns & Crain, Ltd

(57) ABSTRACT

A container includes two cover halves outwardly and inwardly pivotable via hinges. Retaining hooks for locking the cover halves are arranged at the upper edges of two walls. The cover halves have openings along their sides for receiving the retaining hooks. Moving the retaining hook toward the center of the side walls preloads a spring element. For locking, the cover halves are pivoted inward and pressed onto the retaining hooks, which slide toward the center of the side walls and penetrate into the openings. The retaining hooks are moved back and snap in on the top side of the cover halves. Protrusions on the retaining hooks and on the underside of the cover halves raise and keep the cover halves raised during unlocking.

20 Claims, 10 Drawing Sheets

(51) Int. Cl.
*B65D 43/16* (2006.01)
*B65D 50/04* (2006.01)

(52) U.S. Cl.
CPC ..... *B65D 50/046* (2013.01); *B65D 2215/02* (2013.01); *B65D 2251/02* (2013.01); *B65D 2251/1025* (2013.01); *B65D 2251/1083* (2013.01)

(58) Field of Classification Search
USPC ..... 292/8; 220/326
See application file for complete search history.

(56) References Cited

U.S. PATENT DOCUMENTS 4,688,675 A * 8/1987 Miller ..... B65D 43/165 206/508
5,328,048 A * 7/1994 Stein ..... B65D 43/16 220/651
5,740,938 A * 4/1998 Hofmann ..... B65D 43/162 220/4.23
5,878,878 A * 3/1999 Wu ..... A45D 40/22 206/307
7,370,218 B2 * 5/2008 Lee ..... G06F 1/1616 361/679.55
7,370,772 B2 * 5/2008 Brunson ..... B65D 50/046 220/326
8,066,143 B2 * 11/2011 Baltz ..... E05D 7/1066 220/826
9,731,876 B1 8/2017 Giraud et al.
9,938,060 B2 * 4/2018 Jian ..... E05C 1/10
2002/0162841 A1 * 11/2002 Shamir ..... A61L 2/26 220/326
2005/0150892 A1 * 7/2005 Miller ..... B65D 19/18 220/324
2007/0080160 A1 4/2007 Lutzke et al.
2017/0251643 A1 * 9/2017 Boudreau ..... A01K 63/04

FOREIGN PATENT DOCUMENTS

JP 2006199321 A 8/2011
WO 9748613 U1 12/1997

* cited by examiner

CONTAINER HAVING A LOCKABLE COVER

CROSS-REFERENCE TO RELATED APPLICATIONS

This application is a National Stage application International Patent Application No. PCT/IB2020/056331, filed on Jul. 6, 2020, which claims priority to Swiss Patent Application No. CH 00901/19, filed on Jul. 11, 2019, each of which is hereby incorporated by reference in its entirety.

TECHNICAL FIELD

The invention relates to a container having a hinged cover for the transport and storage of goods.

BACKGROUND

Containers with hinged covers are generally known. For example, EP 1 428 764 discloses a container having side latches by means of lead seals and US 2009/0173744 discloses a container having side snap closures.

It is the object of the present invention to provide a container with hinged covers which is easy to lock and unlock.

SUMMARY

Rectangular container having pairs of opposing walls and two cover halves, each hinged outwardly and inwardly to close and open the container opening. Retaining hooks for locking the cover halves are arranged on the upper edges of two opposing walls of the container which extend at right angles to the hinges, wherein the cover halves comprise openings along their sides which extend at right angles to the hinges for receiving the retaining hooks. The position of the openings coincide with the position of the retaining hooks when the cover halves are closed.

At least one retaining hook attached to one wall of the container is associated with each side of the cover halves which extends at right angles to the hinges.

The retaining hooks are oriented so that the pointed end of each retaining hook associated with a cover half faces the hinge of the respective cover half in each case.

The retaining hooks are movably attached to the container walls by being movable from a rest position toward the center of the container wall parallel to the upper edge of the container walls. In addition, the retaining hooks are each connected to a spring element which is preloaded when the retaining hook moves towards the center of the container wall, so that it is spontaneously moved back again by the spring force after the retaining hook has moved towards the center.

To close the container and lock the cover halves, the cover halves are pivoted inwards and pressed onto the retaining hooks, causing them to move towards the center of the side walls until they pass completely through the openings in the cover halves, whereupon they are moved back again due to the spring force and snap into place on the top of the cover halves. Manual movement of the retaining hooks causes unlocking by moving the retaining hooks back toward the center of the container, thus bringing the entire hook into the openings in the cover halves.

On the one hand, the retaining hooks can be actuated individually so that only one cover half is opened. For this purpose, the retaining hooks of only one cover half on both opposing sides of the container are moved in one direction away from the hinge of that cover half towards the center of the container. On the other hand, the retaining hooks can also be actuated in pairs so that both cover halves are opened simultaneously. For this purpose, a pair of retaining hooks is actuated on each side of the container at the same time, which are assigned to both cover halves.

For easy movement and operation of the retaining hooks for the purpose of unlocking the cover halves, the retaining hooks each have an opening into which the thumb and finger can be inserted. Hereby only one retaining hook of one cover half or the retaining hooks of both cover halves, can be moved simultaneously.

At least one retaining hook is associated with each opposing side of a cover half. In a particular embodiment, a pair of retaining hooks is associated with each side of a cover half, instead of a single retaining hook. This provides a strengthened locking mechanism and avoids unwanted opening or lifting of the cover halves during displacement of such containers.

In one embodiment of the invention, the retaining hooks are each designed in a sloped or rounded manner on their upper side towards the hinges. This allows an easier and smoother movement of the retaining hooks into the openings in the cover halves during locking.

In one embodiment of the invention, the spring element of a retaining hook is realized by a resilient element of elongated design. In a particular embodiment, the upper end of the spring element is fixed to the retaining hook, extends downwards at an angle and has a free end which rests against a vertically extending element. When the retaining hook with spring element is moved toward the center of the edge of the container wall during unlocking of the cover halves, the lower end of the spring element slides downwardly and the spring element is preloaded. When the retaining hook is released, the spring element with retaining hook springs back into its original position.

In another embodiment, the end of the spring element has a rounded extension to facilitate sliding along the element extending in a perpendicular manner.

In one embodiment of the invention, the movable retaining hooks are each connected to an upwardly directed projection which cooperates with a projection on the underside of the cover half, so that the cover half is lifted when unlocked. In one variant, the projection on the underside of each of the cover halves is beveled towards the free end of the cover halves, wherein the projection connected to the retaining hook has any shape, but is preferably beveled upwards.

In a further embodiment of the invention, each cover half has an additional projection on each of its sides with the openings. The projection cooperates with a shoulder arranged on the inner side of the rim of the container wall. The projection and the shoulder serve to ensure that when the cover halves are lifted during unlocking, the projection is pressed over the shoulder and rests on the shoulder. This causes the cover half to remain raised after lifting. Once a cover half is lifted, it can be easily grasped with the fingers on its sides and opened completely.

If there are no projections on the cover halves with shoulders on the container walls, the cover halves can also be lifted by releasing the retaining hooks very quickly and the retaining hooks spring back to their initial position, with the cover halves resting on the retaining hooks and not falling back down into a horizontal position.

The invention provides the advantage that the container can be easily and quickly locked by simply pushing down the cover halves.

Unlocking is also simple and quick, using only the thumb and forefinger to move the retaining hooks individually or together, automatically lifting the cover halves thanks to the projections and shoulders and also keeping them lifted so that the cover halves can be easily gripped at their edges and pivoted outwards.

The interlock by means of the retaining hooks causes the interlock to have only a small overall height in that only the upper part of the retaining hook protrudes above the top of the cover halves. This allows the overall height of the hooks to be surmounted by a corresponding small frame at the upper edge of the container sides. In one embodiment of the invention, the container has an additional rim on each of the upper edges of the side walls with the retaining hooks, which rim projects above the retaining hooks and on which another container can be stacked.

The entire construction of the retaining hooks with spring element and associated counter element is also recessed relative to the outer surface of the side walls. This means that the construction is less exposed to impacts. In addition, tight and direct storage of containers next to each other without gaps is possible.

In a further embodiment of the invention, the side walls with the retaining hooks each comprise a device for receiving a lead seal. If a lead seal is inserted into this device after a locking operation, it is ensured that the cover halves can only be opened again if the lead seals have been removed again.

The invention is directed to a container with two cover halves which can be locked by means of the retaining hooks according to the invention. The invention is applicable to a container having only one cover face with openings on its sides, which can be locked and unlocked using the same retaining hooks according to the invention.

Further advantages of the invention follow from the dependent claims and from the following description, in which the invention is explained in more detail with reference to an exemplary embodiment shown in the schematic drawings.

DETAILED DESCRIPTION

Figure 1:
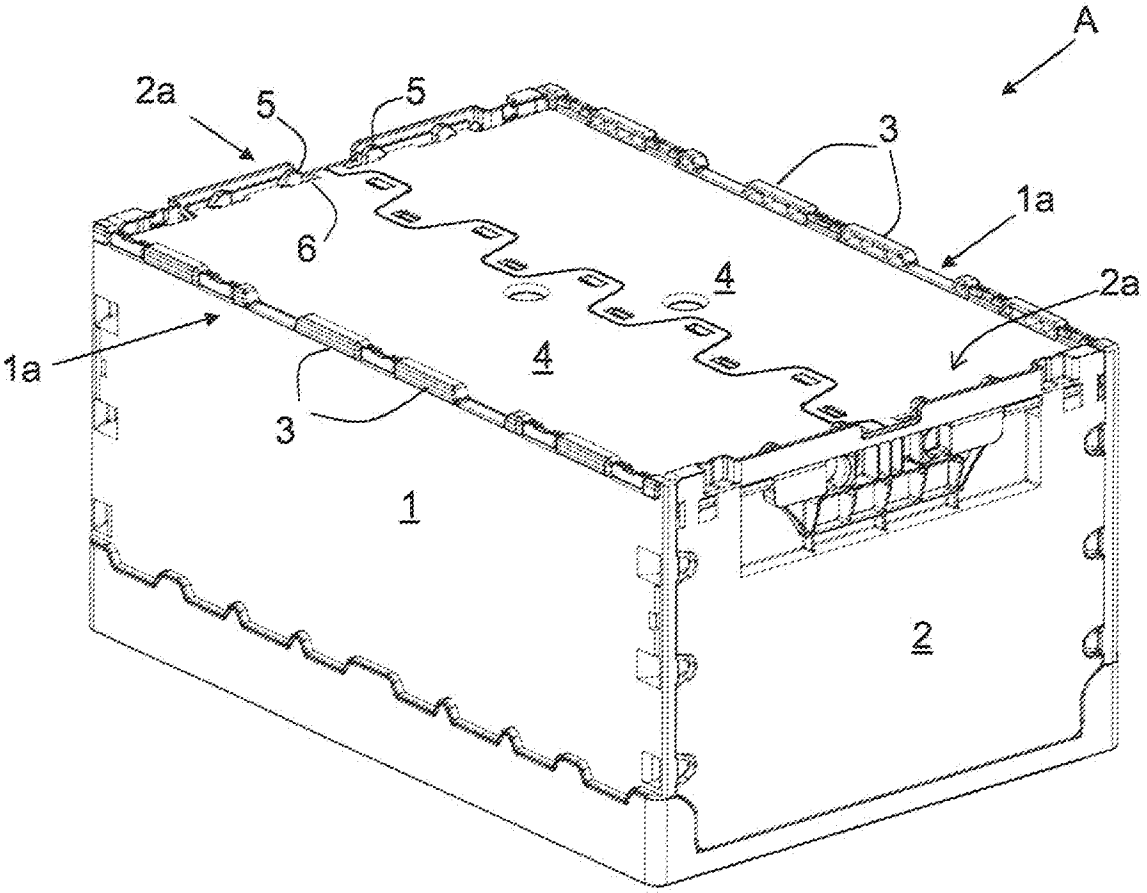
FIG. 1 shows a container according to the invention in perspective with closed cover halves.

FIG. 1 shows a rectangular container A having two first side walls 1 facing each other and two second side walls 2 facing each other. Along upper edges 1*a* of the first, here long, side walls 1, a hinge 3 is arranged in each case for the purpose of fastening and pivoting two cover halves 4 outwards into an open, vertical position and inwards into a closed, horizontal position.

Figure 2:
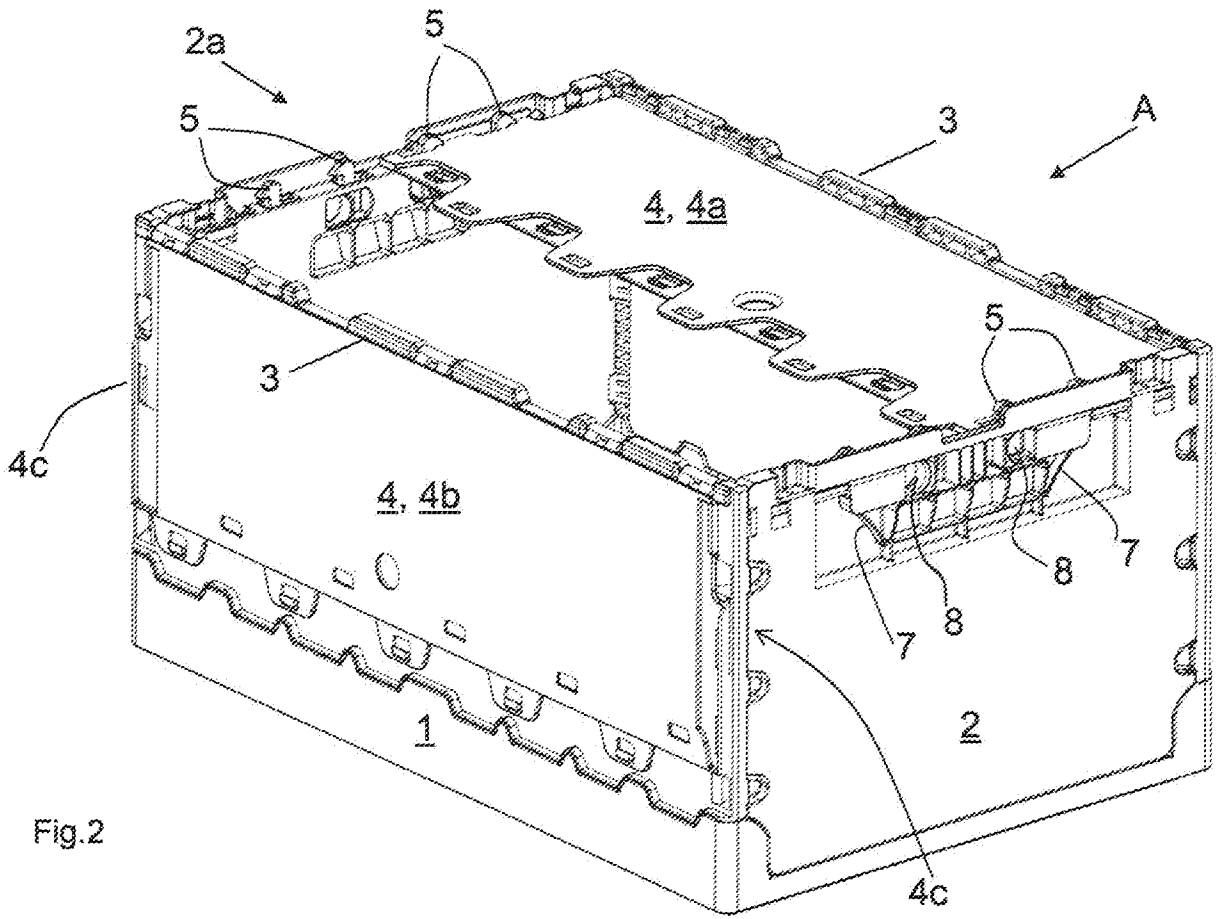
FIG. 2 shows the container of FIG. 1 with one half of the cover open and the other half closed to better show the retaining hooks.

FIG. 2 shows the same container A, wherein here one cover half 4 is pivoted outwards and the underside 4*b* of the cover half is visible. The other cover half 4 is closed, of which the upper cover half 4*a* is visible.

The cover halves 4 have first (here long) sides extending along or parallel to the hinge 3, and second (here short) sides extending perpendicularly to the first sides and parallel to the side walls 2.

Retaining hooks 5 are arranged along the upper edges 2*a* of the second, opposing (here short) side walls 2, by means of which the cover halves 4 can be locked to the short side walls 2. Of the retaining hooks 5, at least one retaining hook is associated with each cover half 4. In the example shown, two retaining hooks 5 are arranged per cover half. The cover halves 4 have openings 6 along their second (short) sides for accommodating the retaining hooks 5 when the container A is closed and locked by means of the two cover halves 4.

Figure 3:
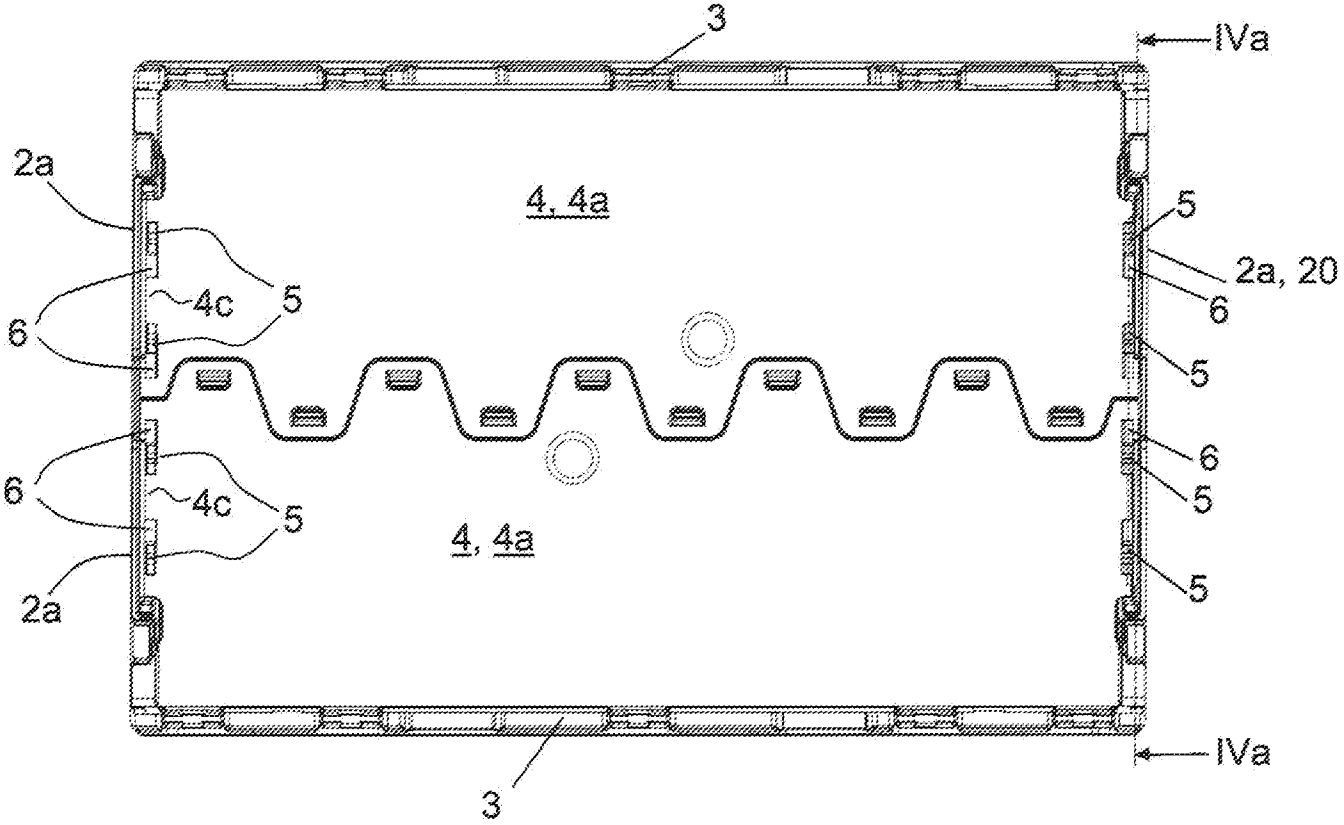
FIG. 3 shows the container of FIG. 1 from above.

FIGS. 1 to 3 show the positioning of the retaining hooks 5 in the openings 6 in locked cover halves 4. Here, the hooks 5 each lie on the upper side 4*a* of the cover half 4 and thus retain the cover half 4 in the horizontal position.

Figure 4A:
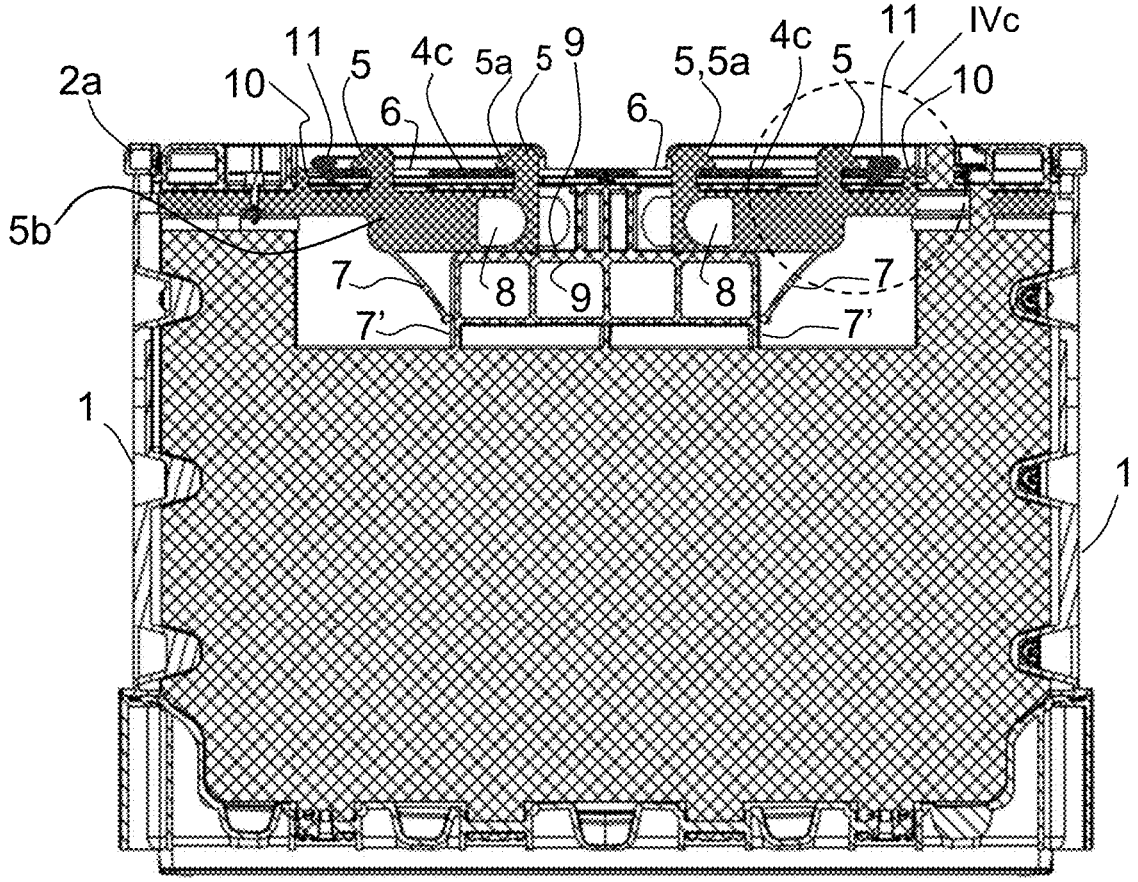
FIG. 4*a* shows the container of FIG. 3 in a sectional view according to IVa-IVa and in particular the construction of the retaining hooks in locked position.
Figure 4B:
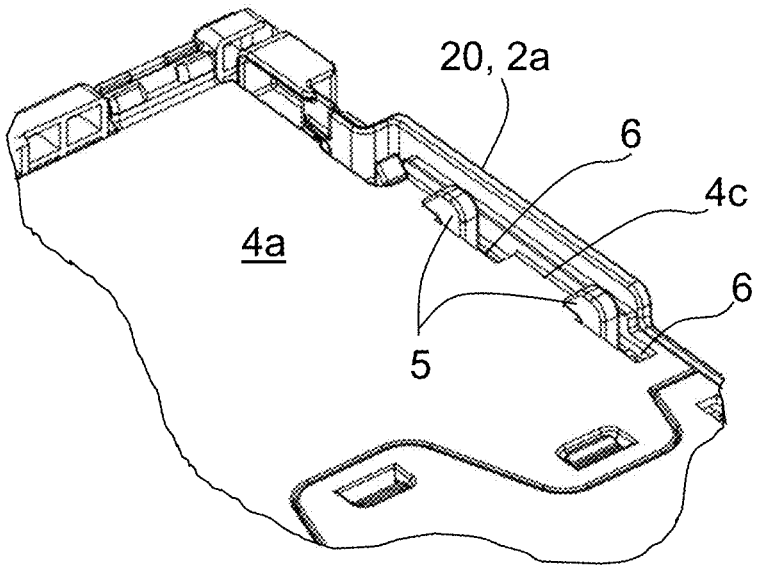
FIG. 4*b* shows a detail of the container of FIGS. 3 and 4*a* in a perspective view from above and in particular the retaining hooks in locking position of the cover halves.
Figure 4C:
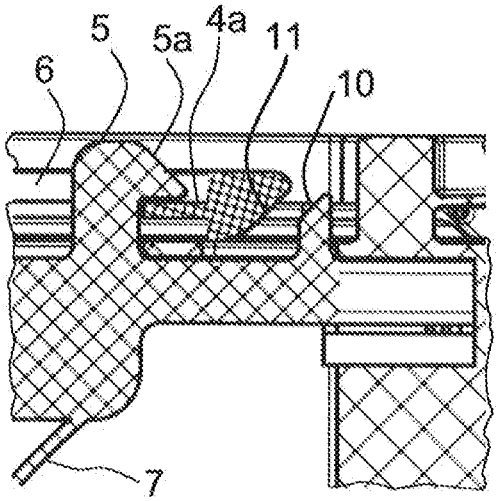
FIG. 4*c* shows a detail of the locking device in enlargement according to IVc in FIG. 4*a*, in particular the retaining hooks and the projections for lifting the cover halves when they are unlocked.

FIGS. 4*a-c* show the construction of the retaining hooks 5 together with spring elements 7 and counter element 7'. A retaining hook 5 comprises the actual hook in each case, which has a beveled shape 5*a* on its upper side, which is directed towards the hinge in each case. The beveled shape 5*a* helps to ensure that, when the cover half 4 is closed, the opening 6 can be pressed more easily over the hook 5, wherein the edge of the opening 6 presses against the hook and pushes it towards die center of the short side wall of the container until the opening 6 reaches the top of the hook and the hook finally snaps onto the upper side 4*a* of the cover half 4, as shown in FIGS. 3, 4*a* as well as FIG. 4*b*. A retaining hook 5 further comprises a body 5*b* having a spring element 7 preloaded against a counter element 7'. A gripping element is further arranged in the body 5*b*, at which the body 5*b* can be gripped in order to manually displace it. In the shown exemplary embodiment, the gripping element is realized by an opening 8 which can be gripped with the thumb or with fingers.

The body 5*b* of the retaining hook 5 is positioned on a sliding element, for example a rail 9, which extends parallel to the upper edge 2*a* of the second side walls 2 and on which the body with the retaining hook 5 can be displaced.

When a cover half 4 is closed, the retaining hooks 5 are pushed towards the middle of the side wall 2, wherein the spring element 7 is pressed against the vertically extending counter element 7' and downwards, thereby being further tensioned. As the retaining hooks 5 snap onto the cover halves 4, the spring elements 7 relax again.

The spring element 7 is realized here in each case by a slightly curved, elongated element, the end of which rests against the counter element 7' and can slide along it. For better movement along the element 7', the spring element 7 can have a rounded extension 7" at its end (see also FIG. 7*b*). The spring element 7 is manufactured, for example, by means of a flexible, high-strength plastic.

FIG. 4*b* clearly shows the snap-in position of the retaining hooks 5 on the cover half 4*a* in the case of locking. In the case of unlocking, the retaining hooks 5 are pushed towards the center of the container into the free space of the openings 6.

Figure 7A:
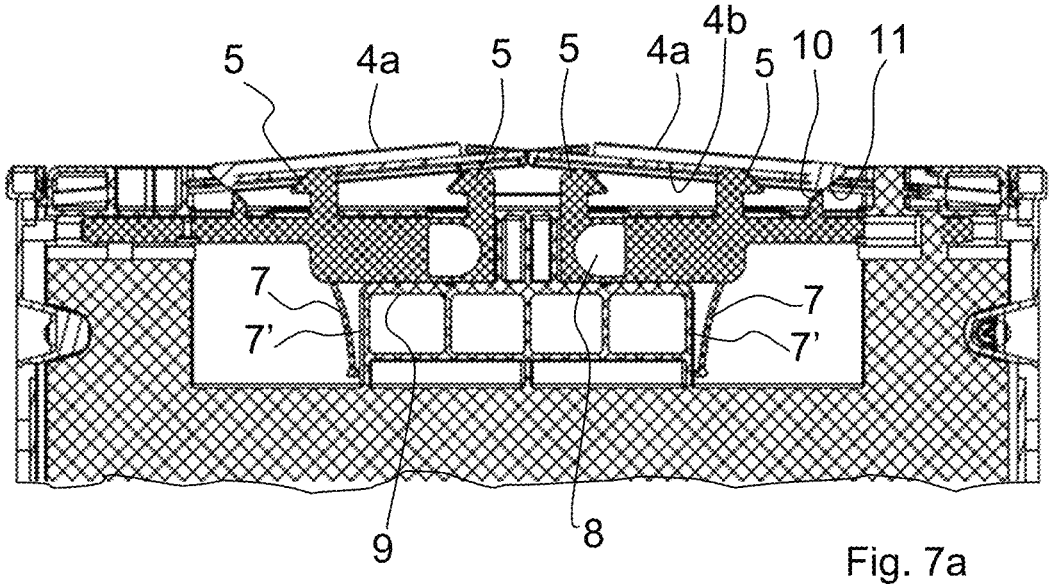
FIG. 7*a* shows the container of FIG. 6 in a sectional view according to VIIa-VIIa and in particular the construction of the retaining hooks in the position of unlocking and lifting the cover halves by projections on the retaining hook and underside of the cover halves.
Figure 7B:
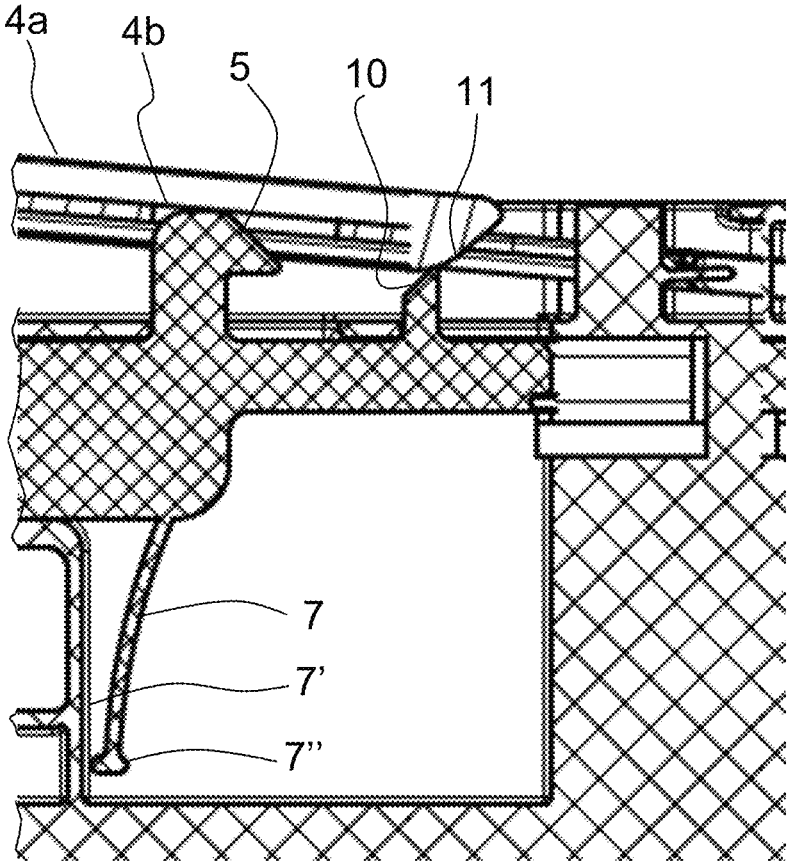
FIG. 7*b* shows a detail of FIG. 7*a*, in particular the retaining hooks and the projections for raising the cover halves when they are unlocked.
Figure 7C:
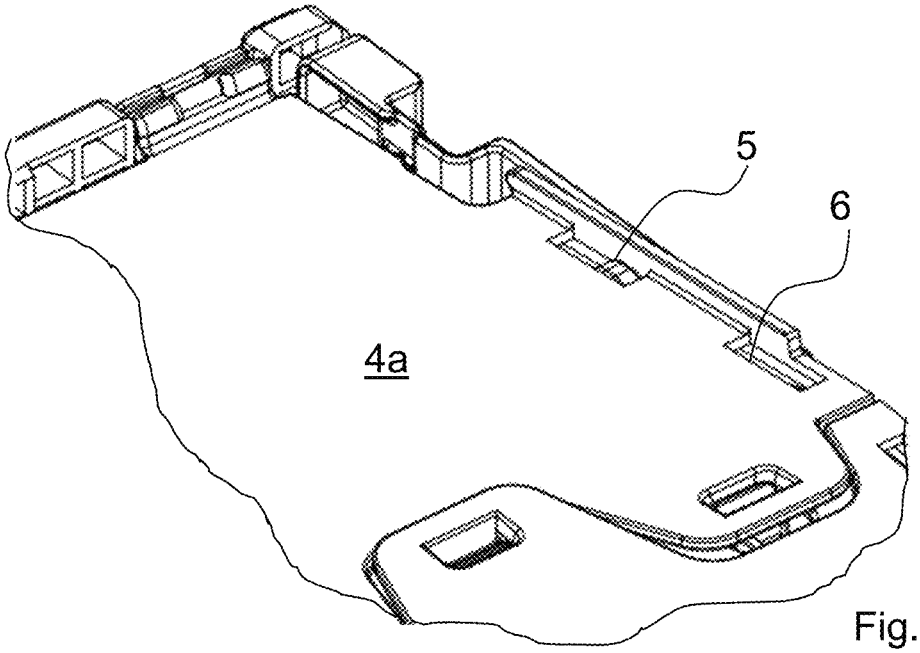
FIG. 7*c* shows a detail of the container from FIGS. 5 and 6 in a perspective view from above, in particular the retaining hooks in the unlocked position.

FIG. 4*c* also shows a projection 10 on the body 5*b* which, when the body 5*b* is moved, cooperates with a projection 11 on the underside 4*b* of the cover half to unlock it (see also FIGS. 7*a* and *b*). In the locked position, the two projections 10 and 11 are not in contact.

Figure 5:
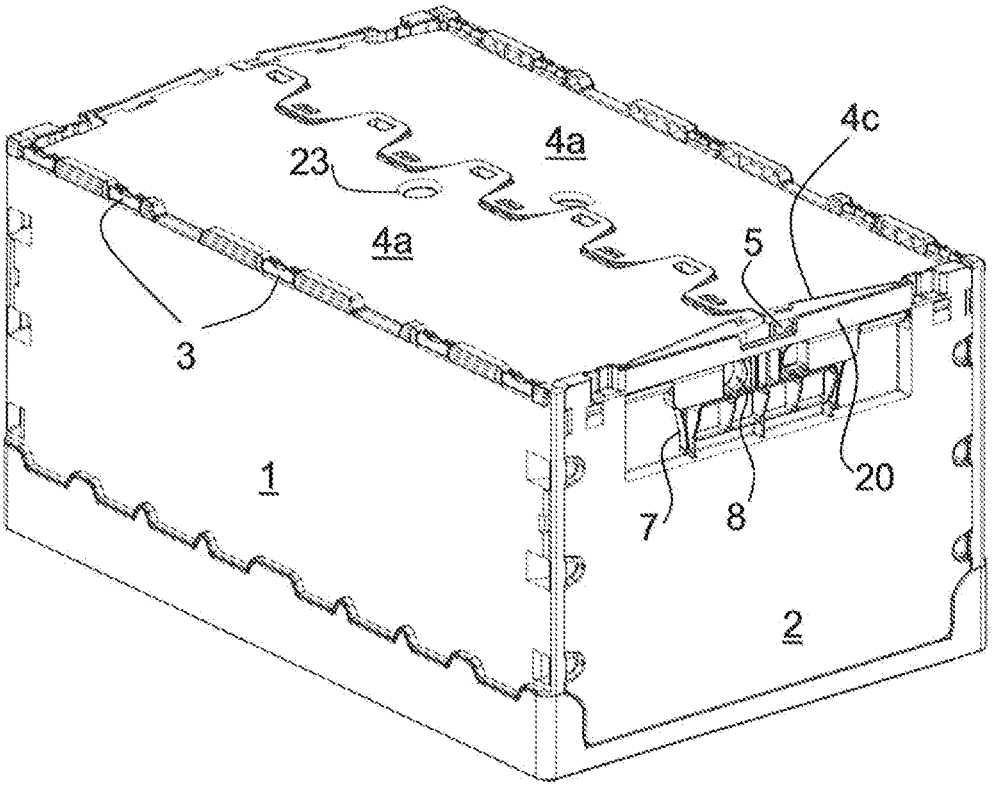
FIG. 5 shows the container according to the invention in a perspective view with the cover halves unlocked and raised.

An unlocking of the cover halves 4 is shown in FIGS. 5, 6 and 7*a-c*. FIG. 5 shows the container A with unlocked cover halves 4, wherein these have been raised slightly onto the retaining hooks 5 and lie on the upper side of the hooks 5. For this purpose, the retaining hooks 5 together with the body 5*b* have been moved towards the center of the side walls 2 by means of the gripping elements 8, until the hooks 5 have disengaged from the upper side 4*a* of the cover halves 4, being pushed even further until they are completely in the opening 6 and rest against the cover half 4 at the end of the opening 6. In this process, the body 5*b* is pushed, wherein an upwardly directed shoulder or projection 10 on the body 5*b* presses against a downwardly directed projection 11 on the underside 4*b* of the cover half Because the retaining hooks 5 are freely located in the openings 6, the cover half 4 can lift upwardly.

For this purpose, the two projections 10 and 11 are provided with an inclined surface so that the two projections 10 and 11 cooperate with each other.

FIGS. 6 and 7*a-c* show the position of the retaining hooks 5 relative to the openings 6 of the cover halves 4, and the cover halves 4 in their raised position. These can then be easily gripped by their side edges or by means of openings 23 and pivoted outwards to open the container A.

Figure 6:
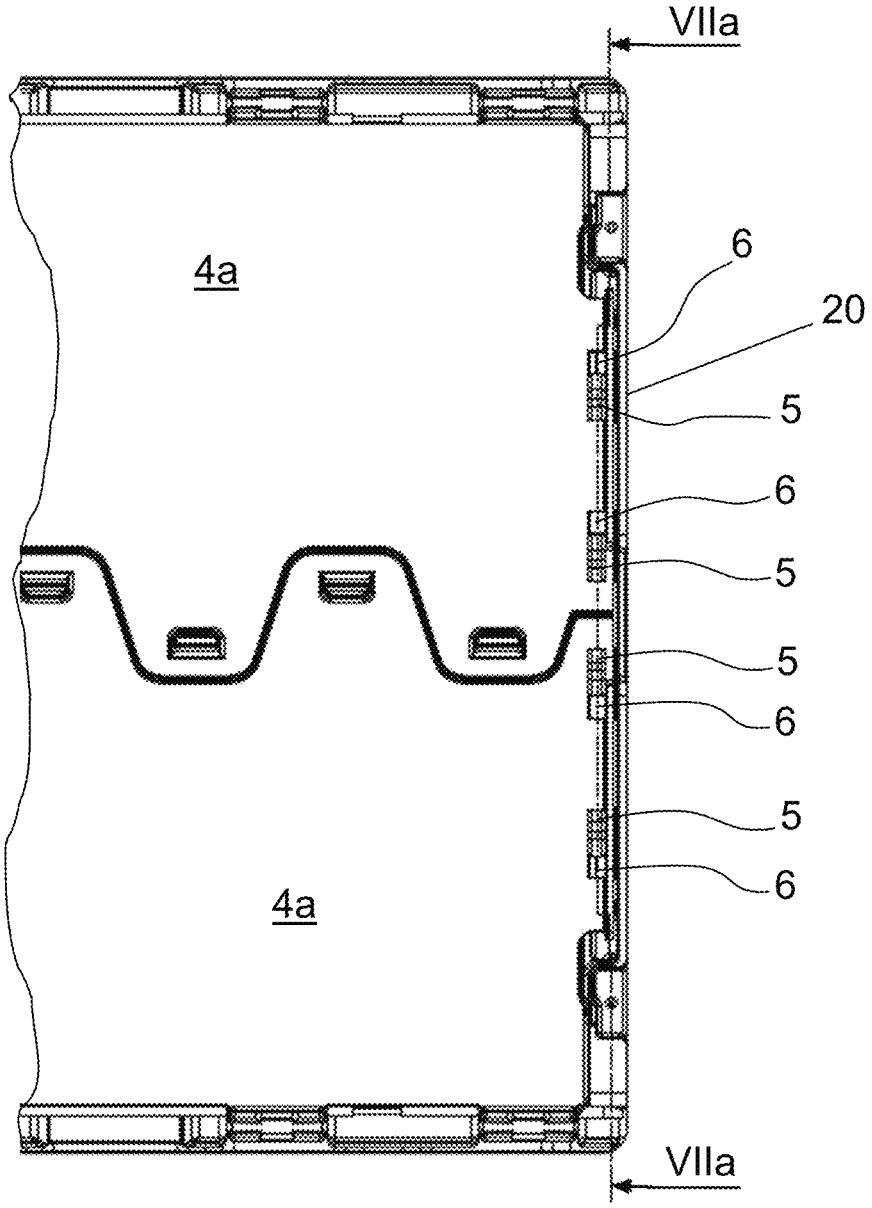
FIG. 6 shows a part of the container of FIG. 5 from above.
Figure 8A:
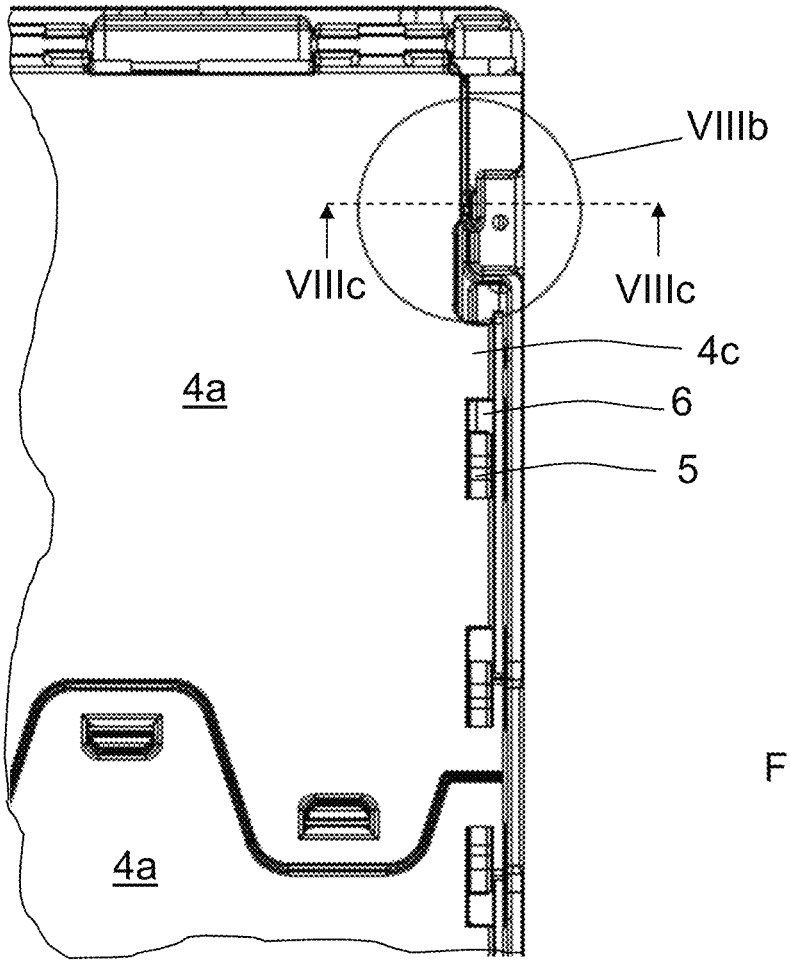
FIG. 8*a* shows a detail from FIG. 6 and in particular a projection on the cover side with a cooperating shoulder on the inside of the container wall.
Figure 8B:
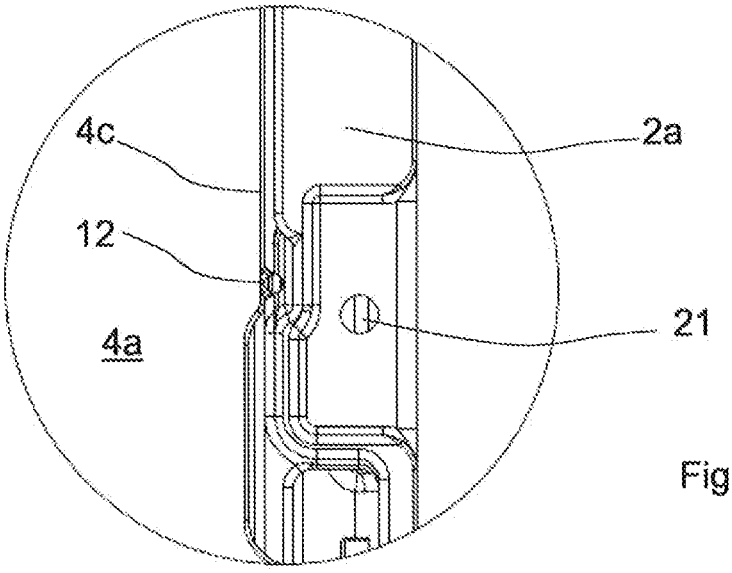
FIG. 8*b* shows the detail VIIb from FIG. 8*a* and in particular the projection on the cover side with cooperating shoulder on the inside of the container wall.
Figure 8C:
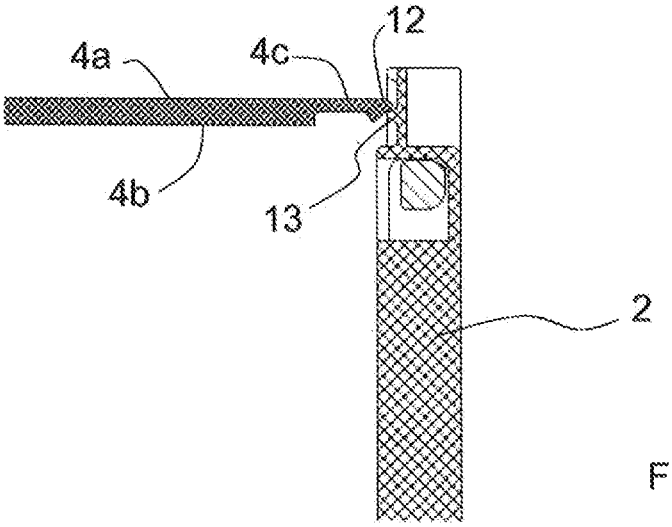
FIG. 8*c* shows a cross-section according to VIIIc-VIIIc in FIG. 8*a* and the cooperation of the horizontal projections for lifting the cover halves.

FIGS. 8*a*, 8*b* and 8*c* show a horizontally extending projection 12 on the side edge 4*c* of the cover half 4 and a horizontally extending projection 13 on the upper edge 2*a* of the side walls 2, which cooperate with each other and serve to ensure that the cover halves 4, once they have been raised by the projections 10 and 11, remain raised and do not close and lock again of their own accord. In FIG. 8*a*, the position of the projections 12 and 13 is shown in the circle VIIIb when the cover halves are closed, wherein this position is outside the projections 10 and 11, i.e the projections 12 and 13 are closer to the side wall 1 with the hinges 3 than the projections 10 and 11. When the cover halves 4 are raised, the projection 12 is pressed over the shoulder or projection 13 on the edge 2*a* of the container wall 2, as shown in the plan view in FIG. 8*b* and the cross-sectional view in FIG. 8*c*. When the retaining hooks 5 are released and the spring elements 7 relax again, the projection 12 remains on the shoulder 13 as no downward force is applied to the cover half. The cover half thus remains in the slightly raised position as shown in FIGS. 5-7.

In FIGS. 1-3 and 5-6, edges 20 are shown on each of the edges 2*a* of the side walls 2, in particular projecting beyond the upper surface of the retaining hooks 5. Their purpose is to allow the containers A to be stacked as shown in FIG. 9 without interfering with the retaining hooks 5.

Figure 9:
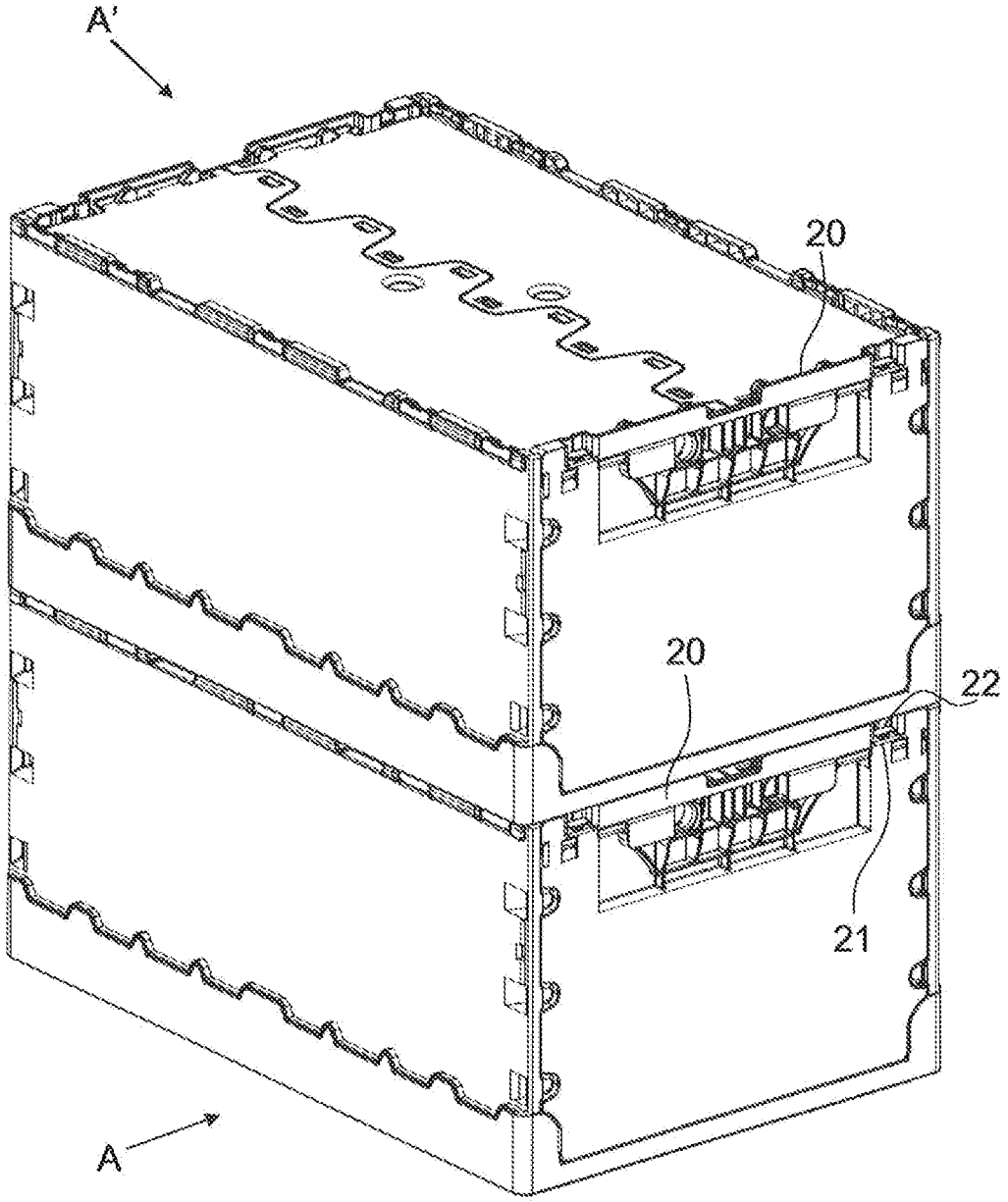
FIG. 9 shows two containers according to the invention, which are locked and stacked on top of each other, as well as lead seals for locking the containers. In the figures, the same reference signs have been used for the same elements in each case, and first-time explanations apply to all figures unless expressly stated otherwise.

FIG. 9 and FIG. 8*b* also show devices 21 for accommodating a lead seal 22 by means of which a container A is securely locked and can only be opened again by releasing the lead seal.

The shown exemplary embodiments of the container according to the invention each have cover halves with a contour at their free ends, which allows the two cover halves to interlock. Further exemplary embodiments of the invention may also have cover halves with straight contours at their free ends.

Although various embodiments of the present invention have been described and shown, the invention is not restricted thereto, but may also be embodied in other ways within the scope of the subject-matter defined in the following claims.

What is claimed is:

1. A rectangular container comprising two opposing first walls, two opposing second walls, two cover halves, and hinges, the hinges comprising at least one hinge coupling each of the two cover halves to a respective one of the opposing first walls such that each of the two cover halves can be pivoted outwards and inwards via a respective hinge in order to open and close the container, wherein retaining hooks for locking the cover halves are arranged on upper edges of the two opposing second walls of the container, each retaining hook comprising a body which extends at a right angle to the hinges and a pointed end movable with and disposed above the body which extends at a right angle to the hinges to define a gap vertically between the pointed end and the body, the cover halves having openings along their sides which extend at right angles to the hinges for receiving the retaining hooks, wherein at least one retaining hook is associated with each side of the cover halves which extend at right angles to the hinges, the retaining hooks are arranged in such a way that the pointed end of each retaining hook associated with a cover half faces the hinge of the respective cover half in each case, and the retaining hooks including the body and the pointed end are movably attached to the container walls and are movable from a rest position towards a center of a respective second wall of the container parallel to the upper edge of the second wall of the container, and the body of each retaining hook is connected to a spring element which is preloaded when the retaining hook is moved, wherein the retaining hook is spontaneously moved back again by the spring force of the spring element such that a portion of the respective cover half adjacent to its opening along its side is retained within the gap between the pointed end and the body.

2. The rectangular container according to claim 1, wherein the pointed end of each retaining hook is respectively beveled or rounded on its upper side towards the hinges.

3. The rectangular container according to claim 2, wherein the body of each retaining hook has an opening for engagement by fingers.

4. The rectangular container according to claim 2, wherein the retaining hooks are individually operable.

5. The rectangular container according to claim 1, wherein the spring element of a retaining hook is realized by an elongated resilient element.

6. The rectangular container according to claim 5, wherein an upper end of each spring element is fixed to a respective body of a retaining hook, extends downwards at an angle and has a free end which rests against a vertically extending element.

7. The rectangular container according to claim 6, wherein the free end of each spring element has a rounded extension.

8. The rectangular container according to claim 5, wherein the body of each retaining hook has an opening for engagement by fingers.

9. The rectangular container according to claim 5, wherein the retaining hooks are individually operable.

10. The rectangular container according to claim 6, wherein the body of each retaining hook has an opening for engagement by fingers.

11. The rectangular container according to claim 7, wherein the body of each retaining hook has an opening for engagement by fingers.

12. The rectangular container according to claim 1, wherein a first horizontally extending projection is arranged on the upper edge of each of the second side walls and a second further horizontally extending projection is arranged on the side of the cover halves having the openings, wherein the first projection cooperates with the second projection when the container is unlocked.

13. The rectangular container according to claim 12, wherein the body of each retaining hook has an opening for engagement by fingers.

14. The rectangular container according to claim 1, wherein the body of each retaining hook has an opening for engagement by fingers.

15. The rectangular container according to claim 1, wherein the retaining hooks are individually operable.

16. The rectangular container according to claim 1, wherein, for each of the second walls, the retaining hooks are operable in pairs using one hand, each pair including retaining hooks corresponding to both cover halves.

17. A rectangular container comprising two opposing first walls, two opposing second walls, two cover halves, and hinges, the hinges comprising at least one hinge coupling each of the two cover halves to a respective one of the opposing first walls such that each of the two cover halves can be pivoted outwards and inwards via a respective hinge in order to open and close the container, wherein retaining hooks for locking the cover halves are arranged on upper edges of the two opposing second walls of the container which extends at right angles to the hinges, the cover halves having openings along their sides which extend at right angles to the hinges for receiving the retaining hooks, wherein at least one retaining hook is associated with each side of the cover halves which extend at right angles to the hinges, the retaining hooks are arranged in such a way that a hook of each retaining hook associated with a cover half faces the hinge of the respective cover half in each case, and the retaining hooks are movably attached to the container walls and are movable from a rest position towards a center of a respective second wall of the container parallel to the upper edge of the second wall of the container, and the retaining hooks are each connected to a spring element which is preloaded when the retaining hook is moved, wherein the retaining hook is spontaneously moved back again by the spring force of the spring element, wherein the movable retaining hooks are each connected to a respective upwardly directed projection movable with the retaining hook which, when the container is unlocked, cooperates with a corresponding projection on the underside of a cover half, and when the container is locked the respective upwardly directed projection is not in contact with the corresponding projection on the underside of the cover half.

18. The rectangular container according to claim 17, wherein the projection on the underside of the cover halves is beveled towards a hinged end of the cover halves.

19. The rectangular container according to claim 18, wherein the retaining hooks each have an opening for engagement by fingers.

20. The rectangular container according to claim 17, wherein the retaining hooks each have an opening for engagement by fingers.

* * * * *